US009339855B2

(12) United States Patent
Hochfellner et al.

(10) Patent No.: US 9,339,855 B2
(45) Date of Patent: May 17, 2016

(54) PROJECTILE DISPENSING SYSTEM AND USE

(71) Applicant: ENVIROLOGICS ENGINEERING, INC., Bracebridge (CA)

(72) Inventors: John Hochfellner, Bracebridge (CA); Kevin Lillie, Bracebridge (CA); Dave Marshall, Bracebridge (CA)

(73) Assignee: ENVIROLOGICS ENGINEERING, INC. (CA)

( * ) Notice: Subject to any disclaimer, the term of this patent is extended or adjusted under 35 U.S.C. 154(b) by 0 days.

(21) Appl. No.: 14/647,091

(22) PCT Filed: Nov. 27, 2012

(86) PCT No.: PCT/CA2012/050854

§ 371 (c)(1),
(2) Date: May 23, 2015

(87) PCT Pub. No.: WO2014/082154

PCT Pub. Date: Jun. 5, 2014

(65) Prior Publication Data

US 2015/0298180 A1 Oct. 22, 2015

(51) Int. Cl.
*B24C 3/32* (2006.01)
*B08B 9/057* (2006.01)

(52) U.S. Cl.
CPC ..... *B08B 9/057* (2013.01)

(58) Field of Classification Search
CPC ..... B24C 3/16; B24C 3/325; B24C 3/327; B24C 7/0092; B65G 53/40; B08B 9/027; F16L 55/46; F28G 1/12; F41A 9/01
USPC ..... 451/75, 76, 99, 100, 38, 39, 40, 87, 88
See application file for complete search history.

(56) References Cited

U.S. PATENT DOCUMENTS

| | | | | | |
|---|---|---|---|---|---|
| 2,087,694 | A | | 7/1937 | Malmros | |
| 4,236,654 | A | | 12/1980 | Mello | |
| 4,707,951 | A | * | 11/1987 | Gibot | B24C 7/0046 451/39 |
| 4,708,534 | A | * | 11/1987 | Gallant | B24C 7/0046 198/757 |
| 4,970,830 | A | * | 11/1990 | Schlick | B24C 7/0092 222/630 |
| 5,129,505 | A | | 7/1992 | Winter | |
| 5,207,034 | A | * | 5/1993 | Lynn | B24C 7/0053 451/88 |
| 6,000,995 | A | * | 12/1999 | Ruholl | B24C 5/04 198/548 |
| 8,398,460 | B2 | * | 3/2013 | Christopher | B24C 3/327 451/100 |
| 9,085,064 | B2 | * | 7/2015 | Cooper | B24C 3/327 |

* cited by examiner

*Primary Examiner* — Robert Rose
(74) *Attorney, Agent, or Firm* — The Miller Law Offices PLC; Steven J. Miller, Esq.

(57) ABSTRACT

In one embodiment the present invention is a system comprising a feeder to feed projectiles. There is a conveyor for metering the projectiles, and that conveyor is in communication with the feeder. A pipe is in communication with the conveyor, for impelling projectiles through the pipe. In another it is use of a barrel internally lined with a helical blade for unconfined metering of projectiles to clean a gas pressurized pipe.

7 Claims, 2 Drawing Sheets

PROJECTILE DISPENSING SYSTEM AND USE

FIELD OF THE INVENTION

The present invention relates to pipe cleaning, and more specifically pipe cleaning with a projectile dispensing system.

BACKGROUND

Transport pipes (especially liquid transport pipes) are known to become infested with many forms of build up, including tubercles in a case of municipal water pipes. The pipes become sclerotic and continually narrow as tubercles build up. Regardless of pipe type (gas/liquid/solid transport), flow eventually occludes with tubercle residue and other build up. Few viable industrial and commercial solutions are available to deal with sclerotic pipes quickly and effectively.

One option is to replace infected pipes, but this is frequently unnecessary, time consuming, impractical in urban areas and established neighbourhoods, expensive, and results in an additional problem of waste pipe disposal.

Another option is to accelerate abrasive projectiles (like rocks of progressive calibre) through infected pipes. A pipe is pressurized with a gas stream, and abrasive projectiles are fed into the stream. The streaming projectiles strike and break away protruding tubercle portions, and discharge out of the pipe along with broken tubercles. The streaming projectiles can also be used to clean away old linings, film, and tar residue. In this option, feeding projectiles from a hopper to a pressurized pipe is particularly difficult. Apart from pressure differential concerns (that can present a safety hazard), the projectiles must be metered in a manner that prevent clogging of the system, and also in a manner that minimizes or altogether eliminates dust emission (from projectile handling and metering). Dust emissions reduce the dispensing system's lifespan.

In an example, one system, disclosed in PCT/GB2007/003369 (published as WO/2008/029149), uses an auger to metre projectiles from a hopper into a pipe. One major difficulty with this system is that it requires all of the hopper, conveyor (in this instance an auger), and outlet pipe to be pressurized (so projectiles cannot be fed into the outlet pipe while, for example, the hopper is at a pressure (like atmospheric pressure) lower than that of the pipe). Another significant difficulty is that, in practise, the projectiles tend to clog the auger relatively easily (because of the auger's axle and the blade configuration projecting therefrom—ie a pocket or confined area is formed where projectiles can gather and clog). The auger also tends to (in the case where the projectiles are stones) confine, compress and crush stones, resulting in dust emission (altogether generally referred to as confined projectile handling). Compression and crushing also interfere with the pipe's ultimate cleaning, to say nothing of damaging the auger itself (wear and tear).

SUMMARY OF THE INVENTION

In one embodiment the present invention is a system comprising a feeder to feed projectiles. There is a conveyor for metering the projectiles, and that conveyor is in communication with the feeder. A pipe is in communication with the conveyor, for impelling projectiles through the pipe.

In another it is use of a barrel internally lined with a helical blade for unconfined metering of projectiles to clean a gas pressurized pipe.

DRAWINGS

DESCRIPTION

Figure 1:
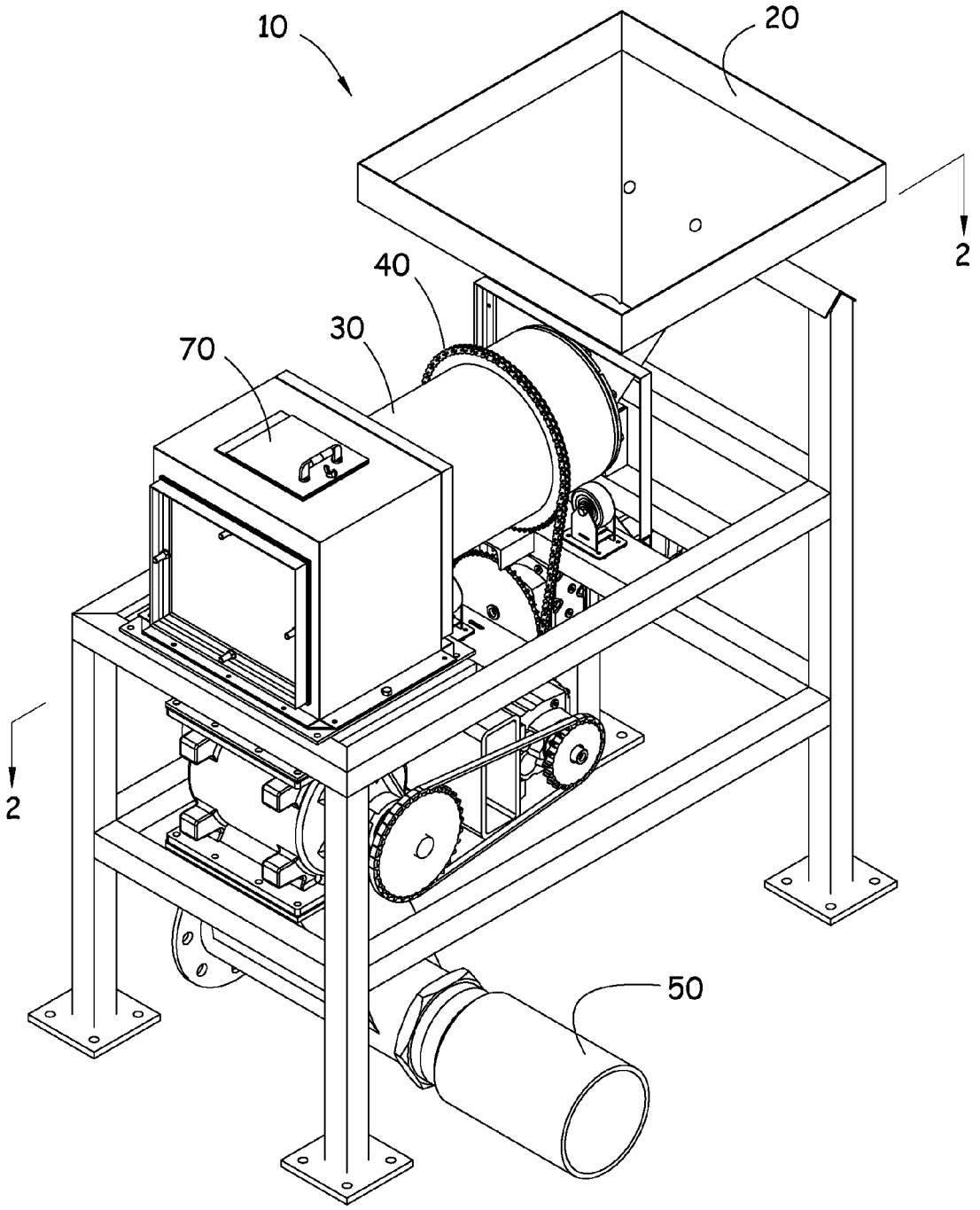
FIG. 1 is a perspective view of a projectile dispensing system.

FIG. 1 shows a projectile dispensing system (10) generally. The system (10) is used to feed projectiles (90) from a feeder (20) (in this exemplary embodiment, a hopper (open to the atmosphere) as an example) into a mean (30) for metering the projectiles (90). The system (10) can be used to clean pipes (50) infested with tubercules (not shown) by streaming (or drawing) gas through the pipe (50) to be cleaned, and metering projectiles (90) into said pipe (50). The projectiles (90) smash and remove tubercules encrusted within the pipe (50). The system (10) can be used for cleaning pipes (50) generally, such as in an instance of tar, old lining, and old film, as well.

The mean (30), in this exemplary embodiment, is an open-ended barrel. More specifically, the barrel is rotatable. In any given embodiment the barrel can be manually rotated or rotated by a variety of means, but in FIGS. 1 and 2 it is shown to be rotatable using a motorized chain and gear system (40).

Figure 2:
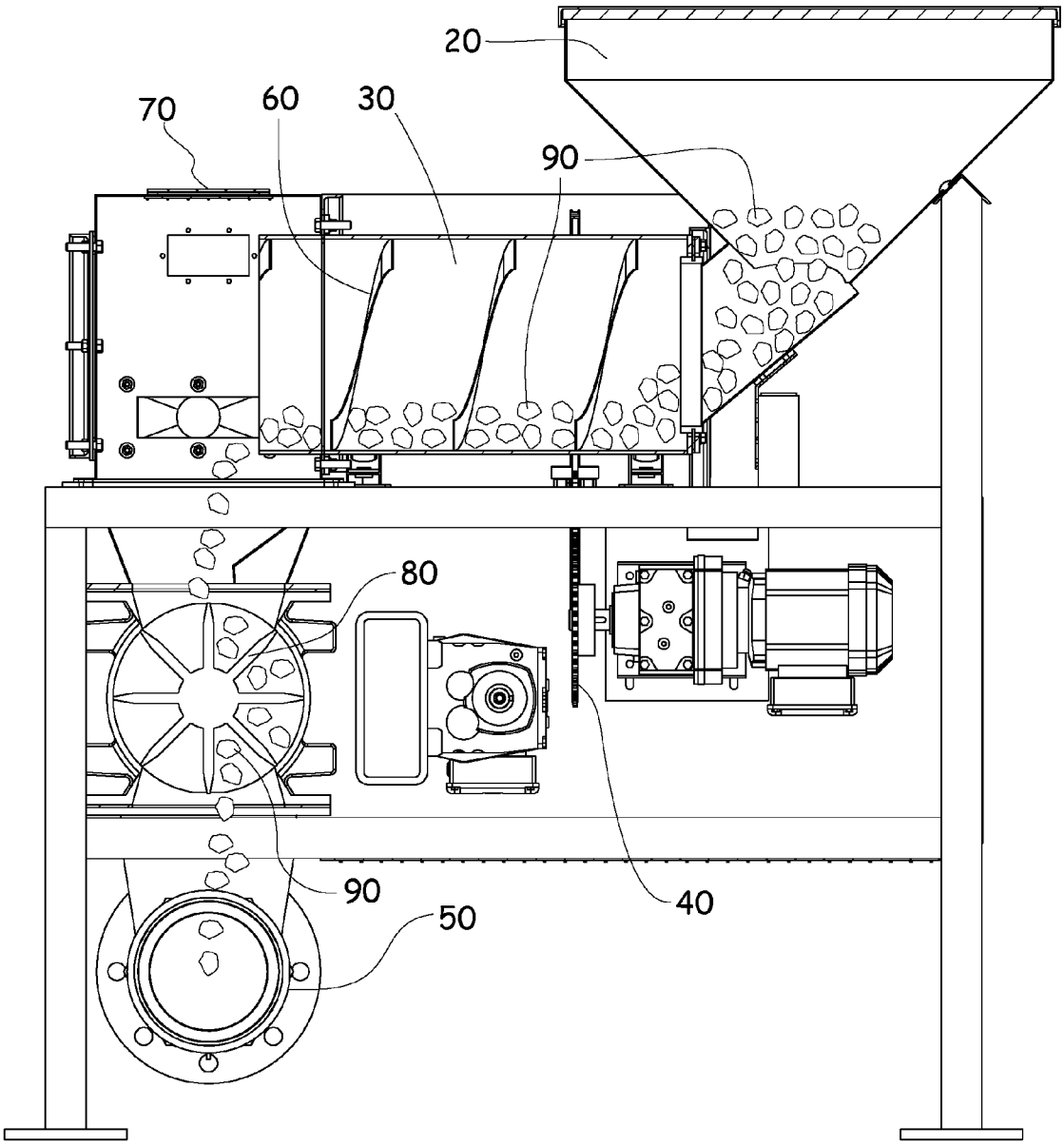
FIG. 2 is a cross section along the line 2-2.

The barrel in FIG. 2 is lined internally with a helical blade (60). The helical blade (60) permits unconfined projectile (90) metering through the barrel, from one end to the other. That is, projectiles (90) are not compressed into a small confined space (as in prior art systems using an auger screw, like WO/2008/029149). Unconfined metering permits, among other things, projectiles (90) to pass ultimately to the pipe (50) without crushing and deformation. Unconfined metering also greatly reduces the chance that projectiles (90) will clog the conveyor (as compared to the prior art).

A bypass access (70) can also be provided. The access (70) allows projectile (90) feeding while bypassing both the feeder (20) and conveyor (30). In an instance where the access (70) is used, projectiles (90) can be slowly, and even individually, introduced for passing to the pipe (50). In instances where a pipe (50) is heavily tuberculated and sclerotic (ie its internal diameter is greatly narrowed, and so flow is constricted and reduced), the slow introduction of individual projectiles (90) acts to prime the pipe (50) for cleaning. Individual projectiles (90) are introduced slowly, to break away tubercule portions, and very gradually increase the internal diameter of available pipe (50). Without priming the pipe (50) with this slow introduction, projectiles (90) can quickly clog heavily tuberculated pipes (50), resulting in a need for total system (10) shutdown, clearing of stuck projectiles (90) manually, and a restart of the system (10). In a more serious case of clogging, the pipe (50) might require unearthing, cutting, and removal, thereby adding significant expense and difficulty to a cleaning project. Priming the pipe (50) reduces odds of system (10) stoppage, and therefore, delay.

The system (10) can also optionally have a valve (80). One type of valve, shown in FIG. 2, is a rotary air lock valve. The valve (80) can be used when operating the system (10) while the feeder (20) and conveyor (30) are at a lower pressure (e.g. atmospheric pressure) and the pipe (50) is at a higher pressure (such as when a pump is attached to the system to stream gas through the pipe (50)). In another embodiment where the feeder (20) and conveyor (30) are at a higher pressure (e.g. atmospheric pressure) and the pipe (50) is at a lower pressure (such as when a vacuum is attached to the pipe to draw gas through the pipe (50)), the valve (80) is not necessary.

A tubercle (not shown) is generally a bumpy, rocky, and rigid protuberance, forming wart-like lesion in pipes (50).

Tubercles arise from natural atherosclerosis and mineral deposition, pollution, residual matter, and living organisms. Tubercle formation is highly likely when any of solid, liquid, and gas matter is conveyed in pipes (50)

A projectile (90) is an impel capable body for firing into pipes (50), to smash tubercles. These include bumpy rocks, smooth rocks, ball bearings, shot, shards, ice, sand, shrapnel, bullets, rounds, and pellets, among others, all of variable calibre, shape, density, and hardness, as required.

In context, streaming means impelling, firing, or propelling (by gas, liquid, magnetic propulsion, or other means). In one embodiment it is preferable to use a pump to stream gas through the pipe (50). Drawing also results in impelling, firing, or propelling (by gas, liquid, magnetic propulsion, or other means), but is distinguished from streaming in that streaming generally refers to forcing (or pushing) a gas through a pipe (50) whereas drawing refers to sucking or vacuuming the gas through the pipe (50). Thus, in one configuration, gas would be streamed by placing a pump (not shown) at one end of the system (ie at one end of the pipe to be cleaned and closer to the conveyor (30)), and in contrast, gas would be drawn by instead placing a vacuum (not shown) at the other end of the system (ie at the other end of the pipe to be cleaned, and further away from the conveyor (30)).

What is claimed is:

1. A projectile dispensing system for cleaning in situ encrusted pipe comprising:

a) a feeder to feed hard abrasive projectiles;

b) a rotatable barrel internally lined with a helical blade, to meter projectiles received from the feeder, the barrel communicating with and positioned external to the feeder; and c) a pipe communicating with and positioned external to the barrel, to receive from the barrel, projectiles for impelling through the pipe by gas flow, for simultaneous full length cleaning and encrustation ejection out said pipe.

2. The system in claim 1 further comprising a bypass access in communication with the pipe, positioned to bypass projectile feeding at the feeder and barrel, for unmetered projectile feeding into the gas flow to prime the pipe for cleaning and encrustation ejection.

3. The system in claim 1 wherein the gas flow comprises at least one of a pump communicating with the pipe to pump gas through the pipe, and a vacuum communicating with the pipe to vacuum gas through the pipe.

4. The system in claim 1 further comprising a selective valve in communication with and juxtaposed between the barrel and the pipe, to transition projectiles from an area of lower pressure to an area of higher pressure.

5. The system in claim 4 wherein the valve is a rotary air lock valve.

6. The system in claim 1 wherein the feeder is a hopper open to atmospheric pressure.

7. The system in claim 1 wherein the feeder is unpressurized.

* * * * *